United States Patent [19]

Derksen et al.

[11] Patent Number: 4,913,097

[45] Date of Patent: Apr. 3, 1990

[54] STEAM GENERATOR THAT BURNS BROWN COAL WITH CINDERS THAT VARY IN COMPOSITION

[75] Inventors: Rudi Derksen; Hans G. Jarmuzewski; Karl-Heinz Maintok; Heinz Langner, all of Oberhausen, Fed. Rep. of Germany

[73] Assignee: Deutsche Babcock Werke Aktiengesellschaft, Oberhausen, Fed. Rep. of Germany

[21] Appl. No.: 333,104

[22] Filed: Apr. 4, 1989

[30] Foreign Application Priority Data

Apr. 28, 1988 [DE] Fed. Rep. of Germany ..... 3814314

[51] Int. Cl.[4] ..... F22B 1/00

[52] U.S. Cl. ..... 122/4 D; 110/204; 165/104.16; 122/406 R

[58] Field of Search ..... 110/204, 245; 122/4 D, 122/406 R; 165/104.16

[56] References Cited

U.S. PATENT DOCUMENTS

| | | | |
|---|---|---|---|
| 4,416,418 | 11/1983 | Goodstine et al. | 122/4 D X |
| 4,552,097 | 11/1985 | Jarmuzewski | 122/4 D |
| 4,656,972 | 4/1987 | Shimoda | 122/204 X |
| 4,766,851 | 8/1988 | Emsperger et al. | 122/4 D |

*Primary Examiner*—Edward G. Favors
*Attorney, Agent, or Firm*—Max Fogiel

[57] ABSTRACT

To make it possible to burn brown coals with cinders that vary in composition in the fluidized bed (6) of one and the same steam generator, one of the flue surfaces (12 or 13) accommodated in flues (2 and 3) downstream of the bed is exploited by way of communicating lines (43, 44, and 45), which can be blocked off, as either economizers or superheaters as desired. The economizer mode is employed when a prescribed volume of flue gas is recirculated through a recirculation line (29) to maintain a fuel-type dictated low bed temperature of preferably 730° to 760° C. The superheater mode is employed when less flue gas is recirculated to maintain a fuel-type dictated higher bed temperature of preferably 820° to 805° C.

2 Claims, 2 Drawing Sheets

STEAM GENERATOR THAT BURNS BROWN COAL WITH CINDERS THAT VARY IN COMPOSITION

Figure 1:
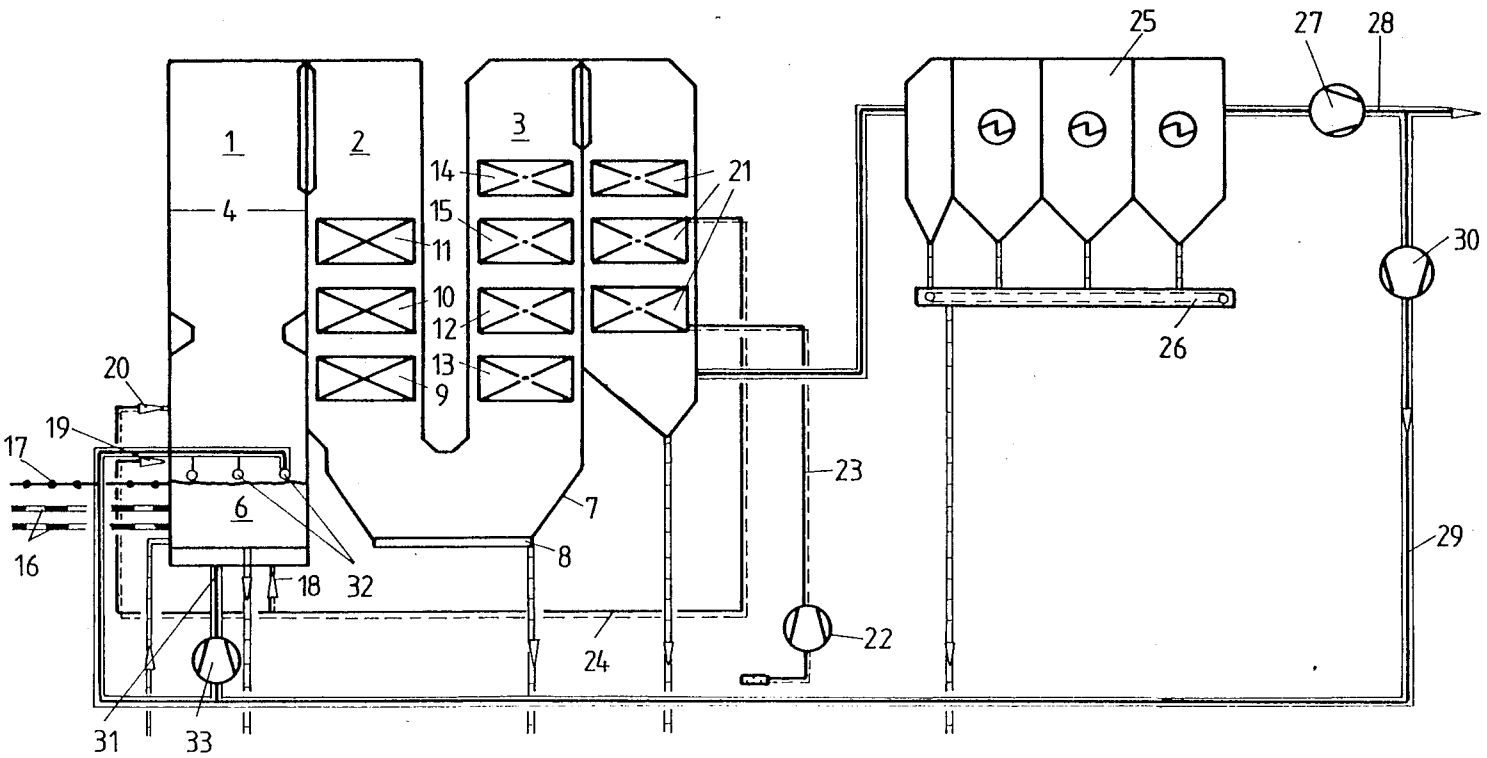

The invention concerns a steam generator that burns brown coal with cinders that vary in composition in a fluidized bed and a method of combustion as recited in the preamble to claim 1.

Brown coals with an alkali content (in terms of $Na_2O$) of less than 2% can be burned in steam generators by stoking fluidized beds with dust. If the cinders contain a higher level of alkali oxides and/or salts (as in saliniferous lignites), the brown coal will be more difficult to burn in that the alkalis considerably lower the softening point of the cinders and lead to caking, even at low temperatures.

To eliminate the alkali-associated drawbacks of stoking with saliniferous lignites, the combustion temperature can be decreased by recirculating cool flue gas. A prior and as yet unpublished German Application P 3 712 801.9 describes a method of burning saliniferous lignites wherein cool flue gas is pumped into a fluidized bed and the open space above it such that the heat released into the flue gas and the cooling of the walls of the open space above the fluidized bed and at the gas end of the open space keep the temperature at approximately 780° C. or less. The temperature of the walls that demarcate the open space remains below the softening point of the cinders.

Measures to avoid the problems associated with alkalis are only necessary when saliniferous lignites is being burned.

The object of the invention is to provide a steam generator that can be stoked with brown coals that have either more or less than 2% alkali in the cinders.

This object is attained in accordance with the invention in a steam generator of the aforesaid type by means of the characteristics recited in claim 1. A method of burning brown coal is recited in claim 2.

The steam generator is intended for burning saliniferous lignites at the steam end. Special consideration is devoted to the particular problems that occur when alkalis are present in the cinders of saliniferous lignites. Thus, the temperature of the fluidized bed is kept low by transferring some of the heat from the combustion that occurs in the bed to the recirculated cool flue gas. Since brown coals with a lower level of alkalis in the cinders can be burned at a higher bed temperature, the recirculation of flue gas can be completely or partly eliminated. To allow stoking the same steam generator with low-alkali and alkali-free brown coals subject to these altered combustion-end measures in relation to flue-gas temperature and volume, the invention makes it possible to shift some flue surfaces from economizer to superheater operation with less additional expenditure in internal communication lines. Thus, the higher combustion temperature that occurs when stoking with low-alkali brown coals allows the vaporizer to absorb more heat. This increase is compensated for by reducing the overall flue surface of the economizer to decrease its heat absorption. The lower volume of flue gas present in the convection section when low-alkali brown coals are burned is simultaneously compensated for by converting the now unnecessary economizer flue surface into a superheater flue surface.

Figure 2:
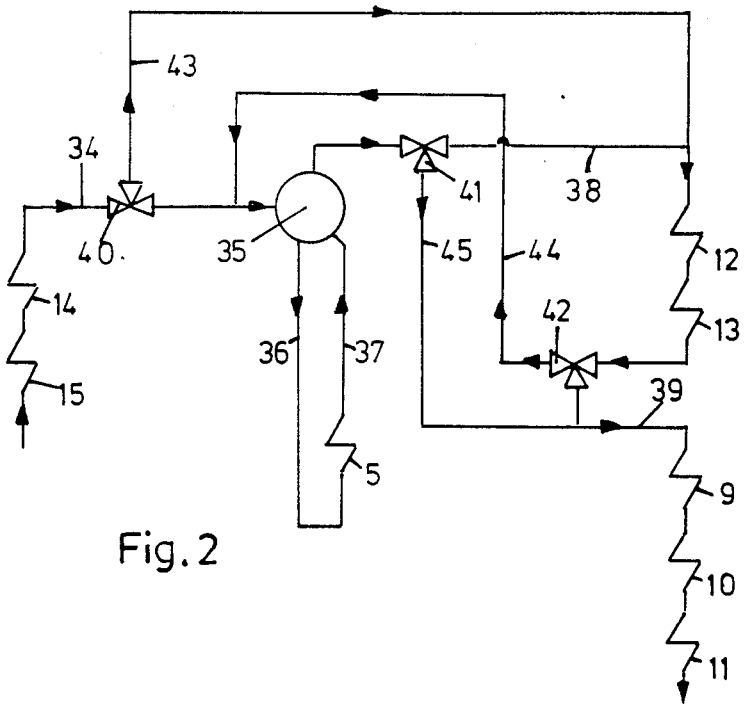
Figure 3:
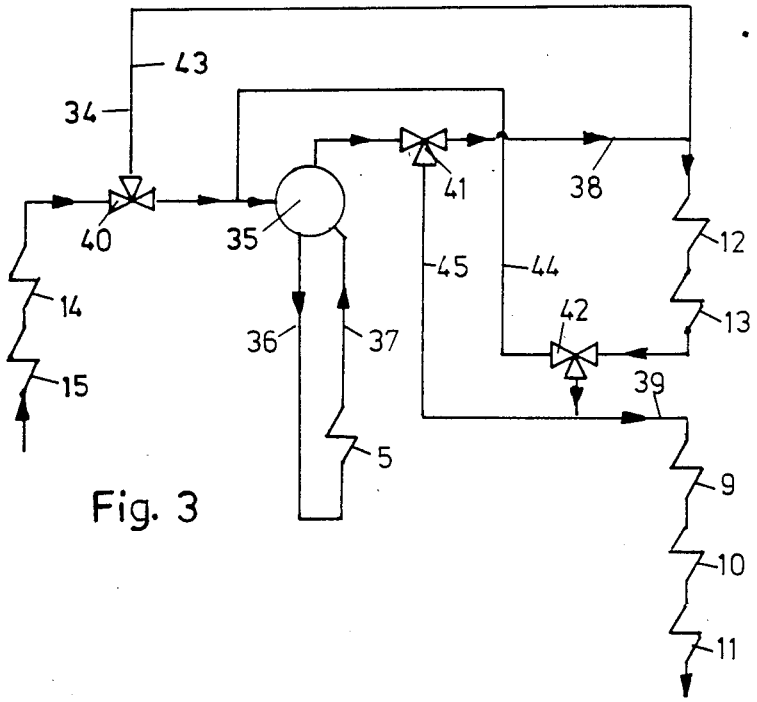

One embodiment of the invention will now be described in greater detail with reference to the drawing, wherein FIG. 1 is a diagram of a steam generator that burns brown coal with cinders that vary in composition, FIG. 2 illustrates the steam-end system for burning saliniferous lignites, and FIG. 3 illustrates the steam-end system for burning brown coal with a low content of alkali in the cinders.

The illustrated embodiment is a multiple-flue boiler with three flues 1, 2, and 3 enclosed by gas-tight pipe walls 4 with water and steam flowing through them. Pipe walls 4 act as an evaporator flue surface 5. First flue 1 functions as a combustion chamber and accommodates a fluidized bed 6 at the bottom. A constriction can be bent in over fluidized bed 6 to further mix the flue gases. The inside of first flue 1 has no stacked flue surfaces and constitutes a free space. Second and third flues 2 and 3 communicate through a boiler funnel 7, at the bottom of which is a mechanism 8 for extracting any flue dust that occurs. Second and third flues 2 and 3 constitute a convection section and accommodate flue surfaces 9 through 15 that can be exploited as either superheaters or economizers. Flue surfaces 9 through 15 are cleaned with soot blowers.

Coal is introduced into fluidized bed 6 at several infeeds 16 and burned in association with air. Additives are introduced into fluidized bed 6 along with the coal or separately, through another infeed 17.

Preheated combustion air is pumped into fluidized bed 6 through nozzles 18 in the floor. The air can also be supplied discontinuously in the form of primary air through floor nozzles 18 and in the form of secondary and tertiary air into the space above fluidized bed 6 in the form of secondary and tertiary air through injection points 19 and 20. The air is preheated in the present case in a recuperative pipe-type preheater 21 that communicates with third flue 3. A regenerative preheater with rotating or stationary storage volumes can be employed instead of preheater 21. The combustion air is suctioned out of the atmosphere with a fan 22, conveyed into preheater 21 through a cool-air line 23, and forwarded through a hot-air line 24 to in-floor nozzles 18 and injection points 19 and 20. The primary, secondary, and tertiary air can also be compressed by separate fans.

Downstream of preheater 21 is a flue-gas filter 25. Any flue dust that occurs in flue-gas filter 25 is eliminated by way of an extraction mechanism 26. A flue-gas blower 27 conveys the cooled and filtered gas to an unillustrated stack by way of a flue-gas line 28.

Branching off of flue-gas line 28 downstream of flue-gas filter 25 is a recirculation line 29 that accommodates a blower 30. Recirculation line 29 leads to injection points 31 and 32 that open into fluidized bed 6 and into the atmosphere. The difference in pressure inside fluidized bed 6 is compensated with a pressure-boosting blower 33. The recirculated cool flue gas picks up some of the combustion heat released in fluidized bed 6 and accordingly adjusts the temperature of the bed.

The steam generator operates on the natural-circulation method, the water-end section of which is illustrated in FIGS. 2 and 3. The flue surfaces 14 and 15 in third flue 3, which are the last that the flue gas flows through are laid out in the capacity of an economizer and communicate through an incoming-water line 34 with a drum 35 that separates the steam from the water. Evaporator 5, which is in the form of a flue surface in pipe wall 4, communicates with the water space inside drum 35 by way of descenders 36 and risers 37. Communicating with the steam space inside drum 35 is a steam line 38 that extends through flue surfaces 12 and 13 and through another steam line 39 to a superheater in the form of flue surfaces 9, 10, and 11 in second flue 2.

The special feature of the system illustrated in FIGS. 2 and 3 is that the flue surfaces 12 and 13 between the flue surfaces 14 and 15 that act as economizers and the flue surfaces 9, 10, and 11 that act as superheaters can be exploited as either economizers or superheaters as desired, depending on whether saliniferous lignites or low-alkali brown coal are employed. Flue surfaces 12 and 13 are for this purpose integrated into the system by way of communicating lines 43, 44, and 45 and three-way valves 40, 41, and 42.

First three-way valve 40 is accommodated in incoming-water line 34. First communicating line 43 extends from one of the outlets from first three-way valve 40 to the inlet into flue surface 12. Second communicating line 44 leads from the outlet from flue surface 13 to the section of incoming-water line 34 between drum 35 and first three-way valve 40.

Steam line 38 communicates upstream of the inlet into flue surface 12 with first communicating line 43 and accommodates another three-way valve 41. One inlet into second three-way valve 41 communicates by way of a third communicating line 45 with steam line 39, which leads to the inlet into flue surface 9, and with one inlet into a third three-way valve 42. Third three-way valve 42 is positioned in second communicating line 44 between the outlet from flue surface 13 and drum 35.

Three-way valves 40, 41, and 42 can be redirected as indicated by the arrows in FIG. 2 to connect economizer flue surfaces 14 and 15 by way of incoming-water line 34 and first communicating line 43 with flue surfaces 12 and 13, and those with drum 35 by way of second communicating line 44. The steam space in drum 35 communicates with superheater flue surfaces 9, 10, and 11 through third communicating line 45. This procedure interpolates flue surfaces 12 and 13 in the capacity of economizers.

With the medium flowing in the direction indicated by the arrows in FIG. 3, three-way valves 40, 41, and 42 can be redirected to directly connect economizer flue surfaces 14 and 15 to drum 35 and the drum to superheater flue surfaces 9, 10, and 11 by way of steam line 38, flue surfaces 12 and 13, and steam line 39. No medium will then flow through communicating lines 43, 44, and 45. This procedure interpolates flue surfaces 12 and 13 in the capacity of superheaters.

The potential for interpolating the flue surfaces 12 and 13 between economizer flue surfaces 14 and 15 and superheater flue surfaces 9 and 10 as either economizers or superheaters as desired can be attained not only with the aforesaid natural-circulation procedure but also with a compulsory-circulation method of steam generation.

When saliniferous lignite, which is brown coal with an alkali level of 2% or more in the cinders in terms of sodium oxide, is stoked, flue surfaces 12 and 13 are exploited as economizers as illustrated in FIG. 2. Enough cool flue gas is simultaneously pumped into fluidized bed 6 and the space above it by way of recirculation line 29 to maintain the bed temperature at approximately 740° C. Approximately 45% of the overall flue gas is recirculated at full capacity.

When brown coal with an alkali level of less than 2% in the cinders is stoked, flue surfaces 12 and 13 are interpolated in the capacity of superheater as illustrated in FIG. 5. The amount of flue gas recirculated is reduced to approximately 8% to maintain the bed temperature at approximately 850° C.

What is claimed:

1. A steam generator for burning brown coal with cinders varying in composition, comprising: a fluidized bed located in a first flue having an empty space; second and third flues communicating with said first flue; superheaters and economizers in form of flue surfaces located in said second and third flues; a cool end on said steam generator; a fuel gas recirculation line extending from said cool end to said fluidized bed and to said first flue;

2. A method for burning brown coal with cinders varying in composition comprising the steps: recirculating a predetermined and regulated volume of flue gas into a fluidized bed to maintain the temperature of the bed at 730° to 760° C. when said cinders of brown coal being burned contain at least 2% alkali in terms of $Na_2O$; and recirculating less flue gas to maintain the temperature of the bed at 820° to 850° C. when said cinders of the brown coal being burned contain less than 2% alkalis.

* * * * *